US007918115B2

(12) United States Patent
Fredriksson et al.

(10) Patent No.: US 7,918,115 B2
(45) Date of Patent: Apr. 5, 2011

(54) REMOVABLE CORE LOCK DEVICE

(75) Inventors: Robert Fredriksson, Eskilstuna (SE); Johan Widen, Eskilstuna (SE)

(73) Assignee: ASSA AB, Eskilstuna (SE)

( * ) Notice: Subject to any disclaimer, the term of this patent is extended or adjusted under 35 U.S.C. 154(b) by 357 days.

(21) Appl. No.: 12/064,592

(22) PCT Filed: Aug. 29, 2006

(86) PCT No.: PCT/SE2006/000986

§ 371 (c)(1), (2), (4) Date: Aug. 28, 2008

(87) PCT Pub. No.: WO2007/027136

PCT Pub. Date: Mar. 8, 2007

(65) Prior Publication Data

US 2009/0165514 A1 Jul. 2, 2009

(30) Foreign Application Priority Data

Aug. 30, 2005 (SE) ..... 0501911

(51) Int. Cl.
*E05B 27/00* (2006.01)

(52) U.S. Cl. ..... 70/367; 70/358; 70/369; 70/371; 70/492; 70/493

(58) Field of Classification Search ..... 70/367–369, 70/371, 375, 495, 496, 358, 492, 493, 337, 70/401

See application file for complete search history.

(56) References Cited

U.S. PATENT DOCUMENTS

| | | | | |
|---|---|---|---|---|
| 2,036,764 | A | 4/1936 | Lowe | |
| 3,754,422 | A * | 8/1973 | Stackhouse | 70/492 |
| 4,498,327 | A * | 2/1985 | Preddey et al. | 72/341 |
| 4,603,565 | A * | 8/1986 | Strassmeir | 70/358 |

(Continued)

FOREIGN PATENT DOCUMENTS

DE 20202526 U1 7/2002

(Continued)

OTHER PUBLICATIONS

International Bureau, Notification Concerning Transmittal of International Preliminary Report on Patentability (Chapter 1 of the Patent Cooperation Treaty) Mar. 13, 2008.

*Primary Examiner* — Suzanne D Barrett
(74) *Attorney, Agent, or Firm* — Holland & Hart LLP

(57) ABSTRACT

A removable core lock and key device comprises a cylinder housing (10) and a cylinder core (20), which is accommodated in a circular opening in the cylinder housing. A plurality of pin tumblers (22) are movable under influence from code surfaces of a key, wherein at least part of the pin tumblers are provided in a recess (20*b*) in the mantle surface of the cylinder core. A cam adapter (40) is rotatably provided in the opening in the cylinder housing. The cam adapter comprises an engagement portion (40*c*) which engages the recess (20*b*) in the mantle surface of the cylinder core when the cylinder core is in an operative position, wherein at least one of the pin tumblers is movable between a blocking position, in which the engagement portion of the cam adapter cooperates with the at least one pin tumbler to prevent mutual axial movement of the cam adapter and the cylinder core, and a release position, in which mutual axial movement between the cam adapter and the cylinder core is allowed.

8 Claims, 2 Drawing Sheets

U.S. PATENT DOCUMENTS

| | | | | |
|---|---|---|---|---|
| 5,431,034 | A | 7/1995 | Fann et al. | |
| 5,432,034 | A | 7/1995 | Nogami et al. | |
| 6,076,386 | A | 6/2000 | Etchells et al. | |
| 6,568,229 | B1 * | 5/2003 | Heinrich | 70/370 |
| 6,634,197 | B2 * | 10/2003 | Widen et al. | 70/369 |
| 6,748,777 | B1 | 6/2004 | Livingston | |
| 7,448,240 | B1 * | 11/2008 | Huang et al. | 70/492 |
| 2003/0136164 | A1 * | 7/2003 | Widen et al. | 70/369 |
| 2005/0268678 | A1 * | 12/2005 | Price | 70/358 |
| 2008/0276675 | A1 * | 11/2008 | Herdman | 70/493 |
| 2010/0199731 | A1 * | 8/2010 | Kofman | 70/358 |

FOREIGN PATENT DOCUMENTS

| | | |
|---|---|---|
| WO | WO 93/12314 | 6/1993 |
| WO | WO 97/36072 | 10/1997 |

* cited by examiner

REMOVABLE CORE LOCK DEVICE

TECHNICAL FIELD

The present invention relates generally to lock arrangements and more specifically to a lock arrangement that comprises a key-activated construction with a removable core.

BACKGROUND

A cylinder lock comprises a central core and an outer casing or housing in which the core rotates. The housing is mounted in a suitable housing securing construction. A number of examples of prior art technology describe devices that are adapted to provide a removable or exchangeable cylinder lock core that provide the benefit of enabling such locks to be quickly re-keyed by relatively unskilled persons. Such re-keying may be required as a result of a possible deficiency in security or as the result of a lost key or the failure to return a key.

Patent publication U.S. Pat. No. 6,076,386 (Etchells et al) describes a lock which includes a removable core wherein a retaining element in the form of a ball is disposed in a concentrical groove formed on a core housing. One drawback with this solution resides in the deficiency of a code-related blocking mechanism for removal of the core.

A car lock that includes a removable core is described in U.S. Pat. No. 2,036,764, where the connection between the core and an adaptor that actuates the lock operating device has the form of a bayonet fitting which can be removed without requiring the use of a tool to this end. In order to use the lock, it is necessary to insert a long user key into engagement with a groove in the adaptor in order to be able to rotate not only the core but also the adaptor. Removal of the core from the adaptor is achieved with a short key with which the core is rotated in a specific direction through 90° relative to the adaptor.

Although this latter solution provides a simple construction, it has several drawbacks. Firstly, it relies on the strength mechanics of the key tip for rotation of the adaptor, which results in an unreliable operation. Secondly, this lock can be manipulated relatively easily.

SUMMARY OF THE INVENTION

An object of the present invention is to provide a lock which includes a removable core and with which the drawbacks of known lock devices are eliminated or at least reduced.

The invention is based on the understanding that it is possible to design a cam adapter such that a part of the adapter will grip around one or more code pin tumblers disposed in the cylinder core, wherein the position of the code pin tumblers determines whether or not the cylinder core can be moved axially relative to the cylinder housing.

According to the present invention there is provided a key and lock device that includes a removable core as defined in claim 1, and a service key as defined in claim 8.

The inventive device eliminates or at least reduces the drawbacks associated with known technology as mentioned above. The lock device according to the present invention as defined in the accompanying claims has a simple design which, nevertheless, provides a high degree of security with regard to enabling the replacement of the cylinder core.

Further preferred features of the invention will be evident from the dependent claims.

BRIEF DESCRIPTION OF THE DRAWINGS

The present invention will now be described by way of example with reference to the accompanying drawings, in which.

DESCRIPTION OF A PREFERRED EMBODIMENT

Figure 1:
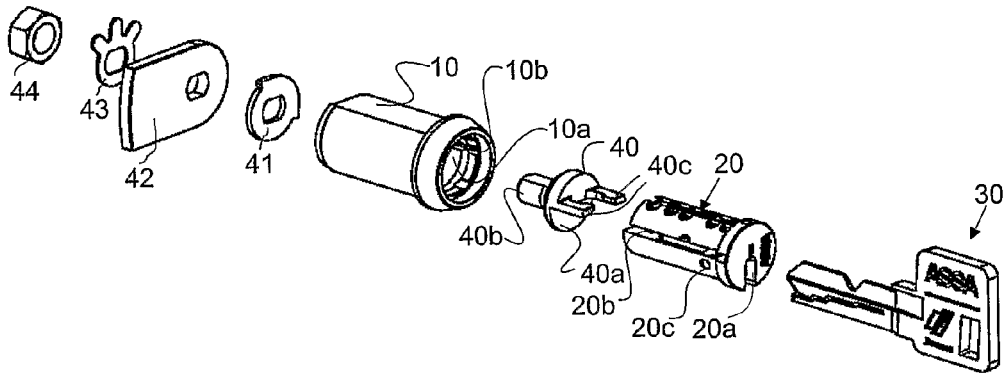
FIG. 1 is an exploded overview of a lock device according to the invention.

There will now be described in more detail a preferred embodiment of the present invention. FIG. 1 is an exploded view of the components of a lock device constructed in accordance with the invention. A cylinder housing 10 includes a generally circular aperture or opening 10*a* which is intended to accommodate a generally circular cylindrical core 20. The core includes a key slot 20*a* which receives a key 30 in a typical fashion. Two side bars (lacking in FIG. 1) are provided in a respective longitudinally extending groove 20*b* in the core, of which one can be seen in FIG. 1. Pressure pins and springs (not shown) are provided for biasing the side bars radially outwards and into engagement with a respective longitudinally extending groove 10*b* in the inner surface of the opening 10*a*, in which one groove can be seen from FIG. 1. A side bar arrangement of the aforesaid type is described for instance in the International Patent Publication WO93/12314 (Häggström), which is included herein by reference.

A cam adapter 40 is rotatably disposed in the inner part of the opening 10*a* in the cylinder housing. The cam adapter includes a circular body 40*a* from which there extends a tail piece 40*b*. The tail piece is adapted to be operatively coupled to a stop washer 41, a cam 42, a locking washer 43 and a nut 44. The cam 42 is held in place on the driver by means of the nut 44. The cam adapter is thus rotatably mounted in the inner part of the opening 10*a* in the cylinder housing 10 and its removal is prevented by the nut 44.

Figure 2A:
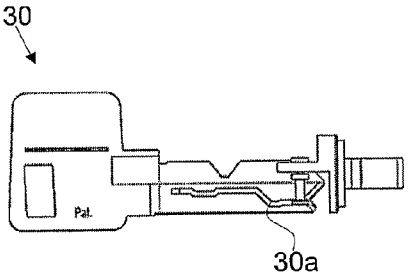
FIG. 2*a-c* are respectively a side view, a perspective view, and a sectioned view of a user key, inner code pins and cam adapter in a lock device according to the present invention.
Figure 2B:
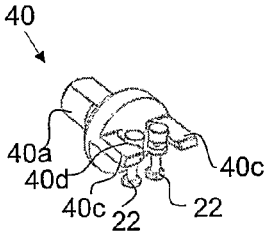
Figure 2C:
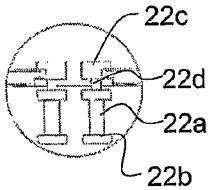

Turning to FIGS. 2*a-c*, it will be seen that the cam adapter also includes two claw-like legs adapted for engagement with a respective code pin tumbler 22 disposed in the inner end portion of the cylinder core 20. The function of these legs will be explained below.

The code pin tumblers 22 have a lower circular body portion 22*a* which terminates in a circular lip 22*b* of larger diameter at its bottom end. The code pins also include an upper circular body portion 22*c* which has a narrower waist portion or circumferential groove 22*d*. When inserting a key into the key slot 20*a*, the pins are forcibly guided in a vertical direction by virtue of the lip portion 22*b* engaging in the code groove 30*a* in the side surfaces of the key bit. This feature is known to the art, for instance from the patent publication WO93/12314 mentioned above.

Figure 3A:
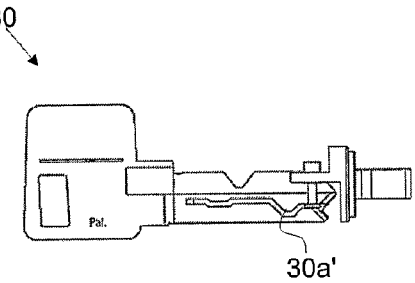
FIG. 3*a-c* is respectively a side view, a perspective view, and a sectioned view of a service key, inner code pins and cam adapter in a lock device according to the invention.
Figure 3B:
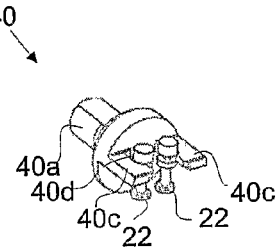
Figure 3C:
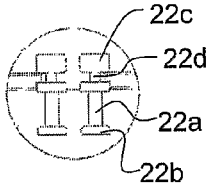
Figure 4A:
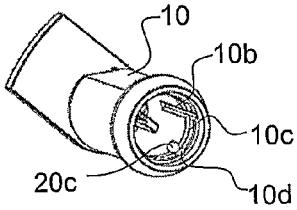
FIGS. 4*a* and 4*b* are views of the cylinder housing of the lock device shown in FIG. 1.
Figure 4B:
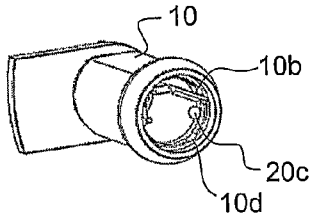

The upper body part 22*c* of the code pins has a diameter which harmonizes with concave recesses in the legs 40*c* of the cam adapter. It will also be seen from FIG. 2*c* that the part of the legs 40*c* that engage around the code pin 22 have a height which is slightly less than the height of the waist portions 22*d* of the code pins. This means than when the waist portions of the code pins are precisely level with the legs of the cam adapter, see FIGS. 3*a-c*, the code pin is able to move past the outer end portions of the legs as the cylinder core is moved in towards or out from the opening 10*a* of the cylinder housing. On the other hand, if the waist portions of the code pins are at a height other than that at which they register with the legs of the cam adapter, see FIGS. 2*a-c*, the upper body portion 22*c* of the code pins will block axial relative movement between the cam adapter and the code pins. Because the cam adapter is mounted in the cylinder housing 10 and the code pins are disposed in the cylinder core 20, removal of the cylinder core from the cylinder housing will be prevented.

The waist portion 22*d* can be placed at different heights in the upper body portion 22*c* of the code pins. This results in different codes. In one preferred embodiment of the invention, the waist can be placed at three mutually different heights, wherewith two code pins will provide nine different combinations.

The construction can be reinforced by providing one or more balls 20*c* in recesses disposed in the barrel or mantel surface of the cylinder core so as to extend slightly beyond said barrel surface. These balls are intended to extend in a circumferential groove 10*c* in the opening 10*a* and function as means for taking-up axially acting forces in all positions of rotation with the exception of when the balls are co-incidental with recesses 10*d*, therewith enabling the cylinder core to be inserted to a core insertion position, see FIG. 5*c*.

Figure 5A:
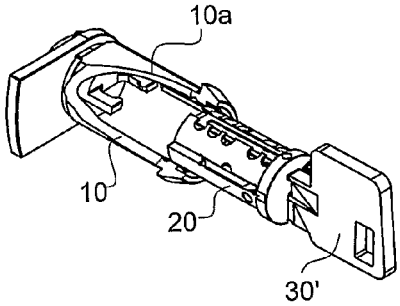
FIG. 5*a-e* are perspective views of a partially cut-away lock device according to the invention and illustrate different stages of fitting a core with the aid of a service key.
Figure 5B:
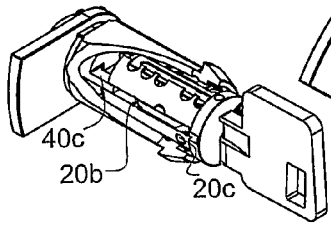
Figure 5C:
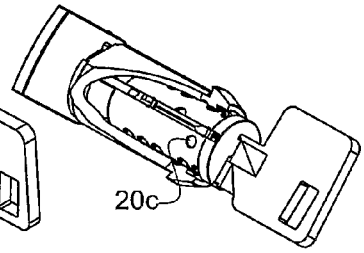
Figure 5D:
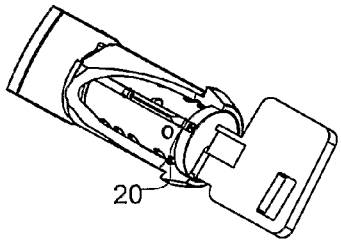
Figure 5E:
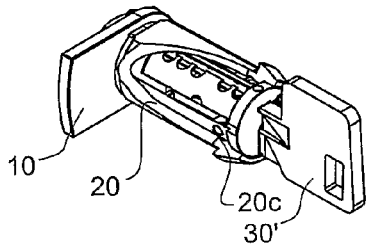
Figure 6A:
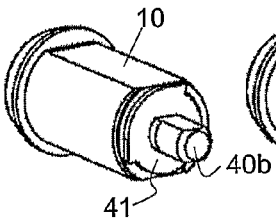
FIGS. 6*a* and 6*d* illustrate different ways of fitting a turn stop.
Figure 6B:
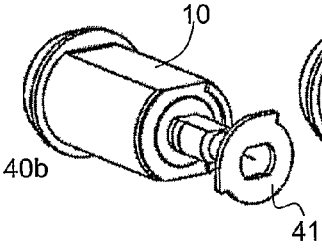
Figure 6C:
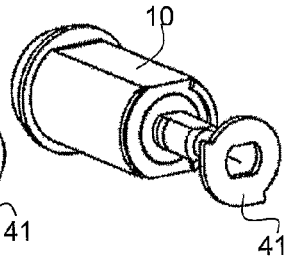
Figure 6D:
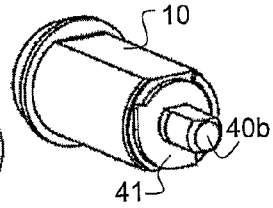

Mounting of the cylinder core 20 will now be described with reference to FIGS. 5*a-e*. FIG. 5*a* shows the cylinder core at the beginning of its insertion into the opening 10*a* of the cylinder housing 10, wherewith a service key 30' is inserted in the key slot 20*a*. FIG. 5*b* illustrates commencement of the engagement of the legs 40*c* of the cam adapter 40 with the longitudinally extending grooves 20*b* in the barrel surface of the cylinder core, wherewith the cam adapter rotates with the cylinder core. However, the balls 20*c* prevent further insertion of the cylinder core. When the cylinder core has been rotated through 45°, see FIG. 5*c*, the balls 20*b* will coincide with the recesses 10*d* in the opening of the cylinder housing. This allows the cylinder core to be moved to a fully inserted position, see FIG. 5*d*. Finally, the cylinder core is rotated to its original position, see FIG. 5*e*, and the service key can be removed from the lock. In this state of the lock, the balls 20*c* block axial movement between the cylinder housing 10 and the cylinder core 20. When mounting of the cylinder core is complete, the lock device can be manoeuvred with a user key.

The cylinder core is dismantled from the lock by carrying out the above steps in a reverse order.

Because the cylinder core and the cam adapter are held in a locked axial position in the cylinder housing through the agency of the balls and corresponding grooves in the cylinder housing opening when said core and adapter are in a locked state, it is a simple matter for an on-site fitter to choose whether the lock device shall be adapted for a right-hand or left-hand turn. The turning direction can be changed by taking off the stop-washer 41 and turning it through 180°, whereafter it is mounted once again on the tail piece 40*b* of the cam adapter, see FIGS. 6*a-d*.

The described lock device affords several benefits. Firstly, there is obtained a simple but nevertheless reliable solution. Several codes for the function of the service key can be obtained while simultaneously the number of components required are kept at a minimum.

Although the inventive lock device has been described with reference to a preferred embodiment, the person of average skill in this art will be aware that variations can be made within the scope of the accompanying claims. Furthermore, although there has been described a lock which includes two longitudinally extending recesses in the cylinder core it will be understood that the inventive concept can also be applied with a different number of recesses. A lock device that includes side bars has been described. Instead of a lock with conventional pins, as described, the lock may comprise upper pins and bottom pins according to the invention.

Balls have been described as means for fixating the cylinder core axially. It will be understood that other solutions can be applied for axial fixation of the cylinder core, or that the fixation achieved through the medium of the cam adapter and pin is the only fixation required.

The invention claimed is:

1. A lock and key arrangement with a removable core, comprising:

a cylinder housing (10) which has a generally circular opening (10*a*);

a generally cylindrical cylinder core (20) which is accommodated in the circular opening of the cylinder housing and which includes a key slot (20*a*) for receiving a coded key (30; 30');

a number of code pins (22) which can be moved by actuation of key code surfaces, wherein at least part of the code pins is disposed in a recess (20*b*) in the barrel surface of the cylinder core;

a cam adapter (40) which is rotatably mounted in the circular opening of the cylinder housing and which is connected operatively to a cam (42);

characterized in that the recess (20*b*) extends longitudinally;

in that the cam adapter includes an engagement portion (40*c*) which in an operative position of the cylinder core engages in the longitudinally extending recess (20*b*) in a mantel surface of the cylinder core; and in that at least one of the code pins is movable between a blocking position in which an engagement portion of a cam adapter co-acts with at least one of the code pins for preventing relative axial movement of the cam adapter and the cylinder core, and a release position in which mutual axial movement between the cam adapter and the cylinder core is permitted.

2. The arrangement according to claim 1, wherein the code pins (22) comprise an upper circular body portion (22*c*) having a circumferentially extending groove (22*d*) in which the engagement portion (22*c*) can move in conjunction with the insertion of a key into the key slot (20*a*).

3. The arrangement according to claim 1, wherein the engagement portion of the cam adapter has two claw-like legs (40*c*) which in an engagement position grip around the code pins.

4. The arrangement according to claim 3, wherein the upper body part (22*c*) of respective code pins (22) has a diameter which harmonizes with concave recesses (40*d*) in the legs (40*c*) of the cam adapter.

5. The arrangement according to claim 4, wherein a part of the legs (40*c*) that grips around the code pins (22) has a height which is slightly smaller than the height of the circumferentially extending groove (22*d*) of the code pins.

6. The arrangement according to claim 1, wherein the code pins (22) with which the engagement portion (40*c*) of the cam adapter co-act are disposed in an inner end-part of the cylinder core (20).

7. The arrangement according to claim 1, wherein a ball (20*c*) is disposed in a recess in the barrel surface of the cylinder core such as to protrude slightly beyond the barrel surface and is adapted to move in a circumferentially extending groove (10*c*) in the opening (10*a*) of the cylinder housing (10).

8. A service key that comprises a code groove (30*a*') which functions to control movement of said at least one code pin (22) to a release position upon insertion of the service key into a lock device according to claim 1.

* * * * *